United States Patent [19]

Cohen

[11] 4,127,053

[45] Nov. 28, 1978

[54] PERCUSSION INSTRUMENT

[75] Inventor: Martin Cohen, Maywood, N.J.

[73] Assignee: Latin Percussion, Inc., Palisades Park, N.J.

[21] Appl. No.: 807,719

[22] Filed: Jun. 17, 1977

[51] Int. Cl.[2] ..... G10D 13/06

[52] U.S. Cl. ..... 84/402; 84/404; 46/191; D56/1 E

[58] Field of Search ..... 46/189, 191, 193; 84/402–406, 408, 103; D56/1 E

[56] References Cited

U.S. PATENT DOCUMENTS

| | | | |
|---|---|---|---|
| 479,636 | 7/1892 | Droop | 84/402 |
| 1,490,914 | 4/1924 | Cornell | 84/402 |
| 3,439,572 | 4/1969 | Cohen | 84/402 |
| 3,592,097 | 7/1971 | Friede | 84/402 |

OTHER PUBLICATIONS

Walberg and Auge Catalog #9, p. 22.

*Primary Examiner*—Lawrence R. Franklin
*Attorney, Agent, or Firm*—Allison C. Collard; Thomas M. Galgano

[57] ABSTRACT

A percussion instrument includes a sound chamber having a cavity therein with at least one opening thereinto, support means secured to the chamber within the cavity, a resilient, elongated member disposed within the cavity of the chamber, one end of which is free-standing and the other end of which is coupled to the support means, a knocker secured to the free end of the resilient member, and a vibratory, elongated rod which is secured to the sound chamber. The rod includes a handgrip along one portion of its length for imparting sustained vibrations to the resilient member and, in turn, the knocker, so that the knocker will strike the walls of the sound chamber to thereby produce a percussion sound. The instrument is particularly suitable for simulating the sound of a jawbone percussion instrument, used for Latin American music.

10 Claims, 7 Drawing Figures

FIG.5
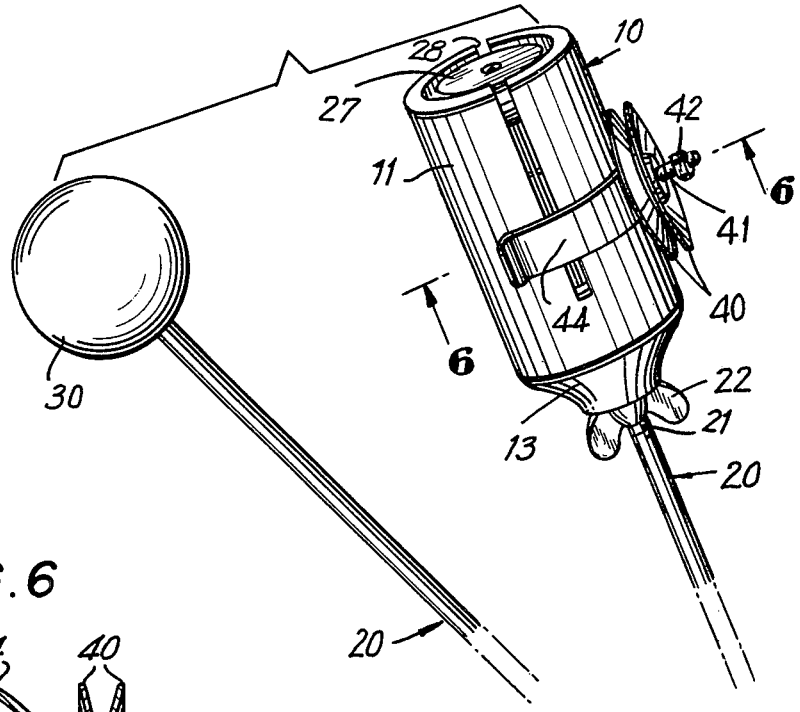
FIG.6
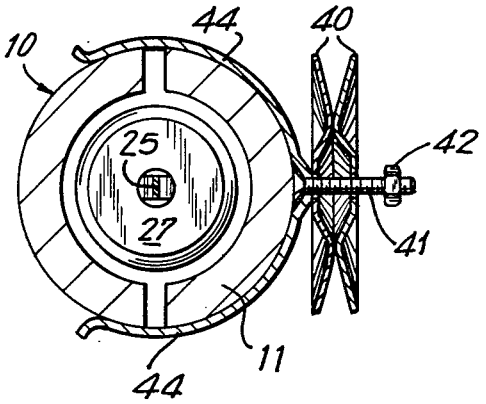
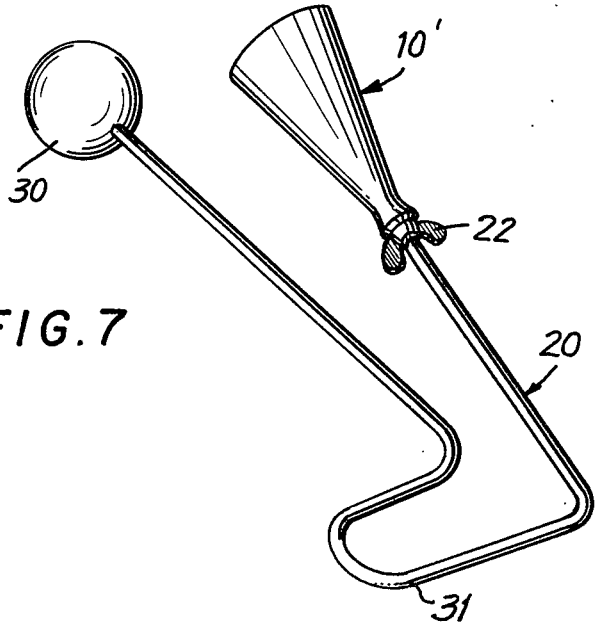
FIG.7

PERCUSSION INSTRUMENT

This invention relates to a percussion instrument. More particularly, it relates to a Latin American percussion instrument, which simulates the sound of a jawbone.

In the accompaniment of Latin American music, various percussion instruments are employed to add rhythm to the music. One of these instruments, commonly found in many Latin American bands, is the jawbone. The jawbone consists of the jaw of an animal, such as a horse, or jackass. After the jawbone is dried, the teeth become loose, so that when the musician holds the entire jawbone by the chin in one hand, and strikes the cheek with the other, the teeth will rattle within the hollow chamber of the jaw, to produce a percussion-like sound. One of the disadvantages of using a jawbone to produce a percussion sound is the inherent weakness at its chin portion. Moreover, natural jawbones are not readily available in great quantities and are often difficult to replace when they become broken.

While various attempts have been made to provide an instrument capable of simultating the sound of a natural jawbone (see, for example, U.S. Pat. No. 3,439,572), which also may be fabricated from readily-available materials and be mass-produced in large quantities, so far as it known, no presently-available percussion instrument affords the advantages of that of the instant invention, nor lends itself to production in a relatively facile and economic method, as herein permitted.

Accordingly, it is an object of the present invention to provide an improved percussion instrument of the type which is capable of simulating the sound of a natural jawbone percussion instrument.

It is also an object of this invention to provide such a percussion instrument which may be constructed from readily-available materials and may be produced in large quantities, and which also may be readily assembled and disassembled.

It is a further object of this invention to provide such a percussion instrument which is relatively unbreakable, reliable in operation and which provides a long operating life.

It is an additional object of this invention to provide such a percussion instrument, which permits readily interchangeability of the sounding components, to permit variations in the sound qualities produced.

It is also an object of the present invention to provide such a percussion instrument, having the foregoing attributes and characteristics, which is of relatively simple design and economic construction.

Certain of the foregoing related objects are readily attained in a percussion instrument, which includes a sound chamber having a cavity therein, with at least one opening thereinto, support means secured to the chamber within the cavity, and a resilient, elongated member disposed within the cavity of the chamber, one end portion of which is free-standing and the other end portion of which is coupled to the support means. A knocker is disposed within the cavity of the chamber and is secured to the free end of the resilient member, and a vibratory, elongated rod is provided having an inner end portion, which is secured to the sound chamber, external of the cavity thereof. The rod has a handgrip along a portion of its length for imparting sustained vibrations to the resilient member and, in turn, the knocker, to effect simulation of the sound of a natural jawbone.

Preferably, the rod includes a generally U-shaped portion integrally along its length, having a length sufficient to serve as a handgrip for the instrument, so that one may then strike the free end of the rod with his other hand, or against a flat object, to play the instrument. Most advantageously, a striking ball may be secured to the free end of the rod, to facilitate being struck against a flat surface. The vibration imparted to the rod and transmitted to the resilient member and sound chamber, may be damped by the musician squeezing his hand around the rod while the instrument is played.

In a preferred embodiment, the sound chamber has an externally-threaded bore extending therethrough, to the cavity thereof, generally opposite the "at least one" opening thereof, and the inner end portion of the vibratory rod is externally threaded and receivable within the threaded bore of the chamber, to effect securement of the rod to the chamber. The rod may advantageously include a nut threadably receivable on the threaded end portion thereof for effecting locking securement of the rod to the chamber. As a result of this readily disassembled construction, the sound chamber may be quickly and easily changed to produce variation in the sound qualities produced. Most desirably, the sound chamber has either a generally cylindrical configuration or a generally conical configuration; the generally cylindrical sound chamber may be advantageously provided with a pair of axially-extending, opposed slots formed in the walls thereof. Most advantageously the support means are provided on the inner end of the rod, the resilient member is fabricated from flat, spring steel, and the knocker has a generally disc-shaped configuration.

In a particularly preferred embodiment of the invention, the instrument may also include at least one pair of tambourine jingles secured to, and externally of, the sound chamber. The jingles may additionally include means for restraining movement of the jingles, when they are not in use, or may also include means for demountably securing the jingles to the chamber. The jingle-securing means desirably comprises a resilient, generally U-shaped clip coupled to the jingles, which may be mounted on the sound chamber.

Other objects and features of the present invention will become apparent from the following detailed description, when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements through the several views:

FIG. 5 is a fragmentarily-illustrated, perspective view, similar to that of FIG. 1, showing tambourine jingles demountably secured to the sound chamber;

FIG. 6 is a cross-sectional view taken along line 6—6 of FIG. 5; and FIG. 7 is a perspective view of another embodiment of the percussion instrument, according to the invention.

Figure 1:
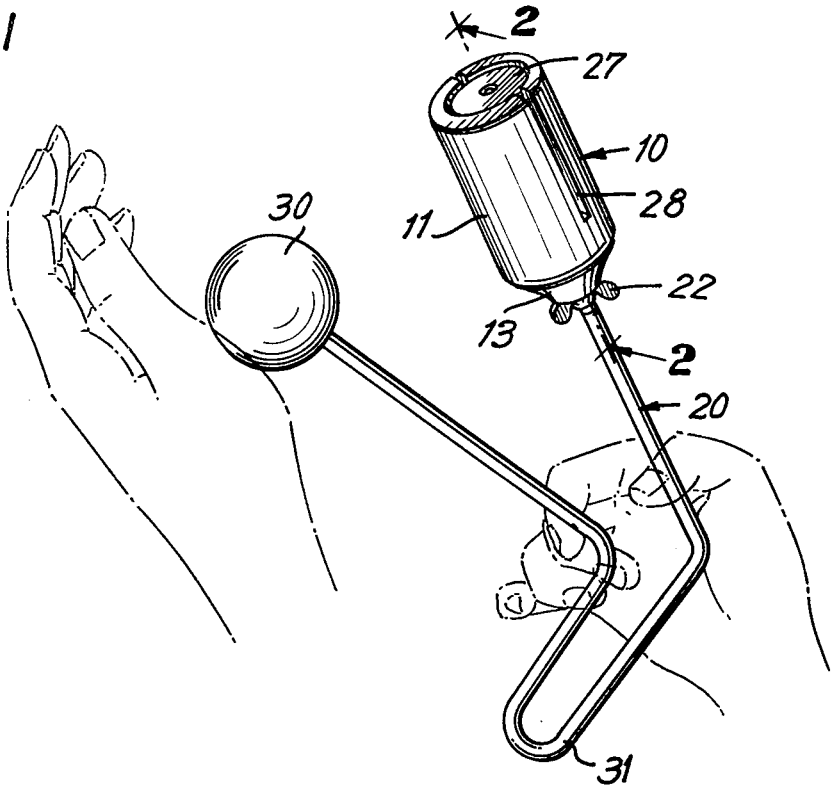
FIG. 1 is a perspective view of one embodiment of the percussion instrument, according to the invention.
Figure 2:
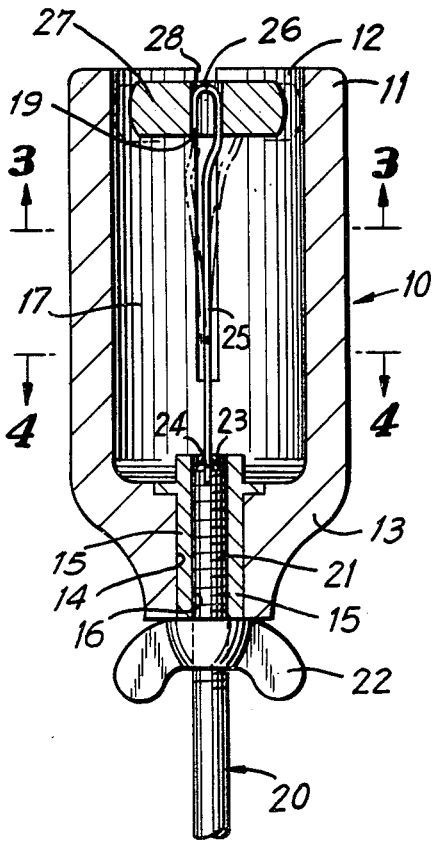
FIG. 2 is an enlarged, cross-sectional view, partly in elevation, taken along line 2—2 of FIG. 1.
Figure 3:
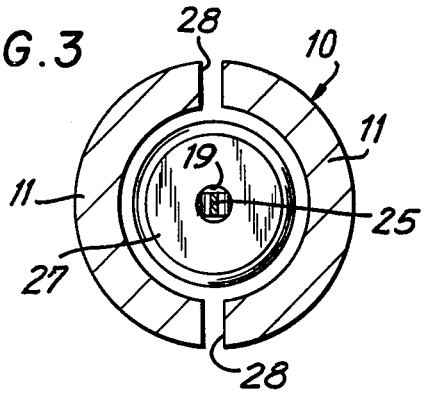
FIG. 3 is a cross-sectional view taken along line 3—3 of FIG. 2.
Figure 4:
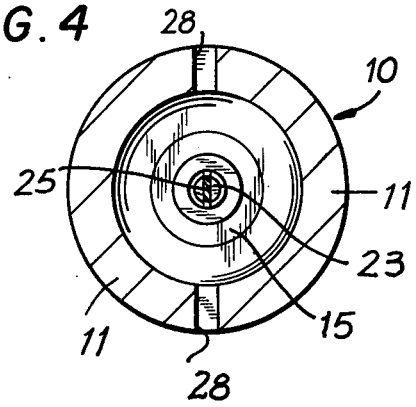
FIG. 4 is a cross-sectional view taken along line 4—4 of FIG. 2.

Turning now in detail to the appended drawings and, in particular, FIGS. 1—4 thereof, therein illustrated is a percussion instrument embodying the present invention, and including a sound chamber, generally designated by the number 10. Sound chamber 10 includes a generally cylindrical, hollow, outer portion 11, defining a cavity 17, the outer end of which has an axially-extending opening 12 thereinto, and the inner end of which merges with a truncated, generally cone-shaped inner portion 13. Outer portion 11 has two, opposed, axially-extending slots 28 formed in the walls thereof and inner portion 13 has an axially-extending bore 14 extending therethrough, in which is secured a tubular metal insert 15, having an internally-threaded, axially-extending bore 16 extending therethrough.

A vibratory rod 20 is provided, having an externally-threaded inner end portion 21, which is threadably receivable within the tubular, metal sleeve 15, mounted within bore 14 of chamber 10. The vibratory rod 20 carries a wing nut 22 on its threaded inner portion 21 which, upon tightening against end portion 13, serves to lock rod 20 and chamber 10 securely together. Rod 20 has a notched inner end 23, in which one end 24 of an elongated and resilient flat bar 25, fabricated from spring steel, is secured. Bar 25 has an opposite, generally hook-shaped, free-standing outer end 26, which is secured within an axially-extending bore 19 of a generally disc-shaped knocker 27.

Secured to the opposite end of rod 20 is a striking ball 30, which when struck against a flat surface, imparts vibrational energy to bar 15 and knocker 27 disposed in sound chamber 10. Midway along rod 20 is a U-shaped portion 31, which serves as a handgrip for the musician playing the instrument. U-shaped section 31 also serves as an extension of rod 20, over which the musician may apply damping to the vibrational energy transmitted along the rod by squeezing his hand tightly against the surface of rod 20.

Rod 20 may be constructed from any rigid material, such as metal, capable of transmitting vibrational energy to knocker 27 and, in turn, sound chamber 10. Striking ball 30 may also be constructed from any hard material, such as wood, plastic or metal. Sound chamber 10 may be of any number of configurations, such as the generally cylindrical configuration shown in FIGS. 1–6, or the generally conical configuration 10′, shown in FIG. 7.

As shown in FIGS. 5 and 6, a pair of tambourine jingles 40 may be demountably secured against the outer wall of sound chamber 10 by means of a generally U-shaped, resilient clip 44; these jingles will provide an additional percussion sound while playing the instrument. The jingles 40 are carried on an externally-threaded stud 41, one end of which is secured to clip 44 and the other end of which carries a nut 42. The tambourine jingles 40 are free to strike the surface of clip 44 or the nut 42 on stud 41. When it is not desired to use the jingles, they may be removed by simply removing clip 44 from chamber 10. Alternatively, the jingles may be directly secured to the outer wall of chamber 10 by securing the stud to the wall thereof. In such a case, when one desires not to use the tambourine jingles, they may be silenced by the insertion of a restraining device, such as a spring clip or pad (not shown) between the tambourine jingles and the surface of the wall, or they can be removed by initial removal of nut 42 from stud 41.

Aside from the instrument's obvious use as a percussion instrument devised to accompany Latin American music, it may also be utilized as a toy, sound prop or decorative device. The instrument, being simply constructed, may be easily mass produced and sold at such costs considerably less than its natural counterpart.

While only several embodiments of the present invention have been shown and described, it will be obvious to those persons of ordinary skill in the art, that many changes and modifications may be made thereunto, without departing from the spirit and scope of the invention.

What is claimed is:

1. A percussion instrument comprising:

a sound chamber having a cavity therein, with at least one opening thereinto, and an internally-threaded bore extending therethrough to said cavity thereof, generally opposite said at least one opening thereof;

a vibratory, elongated rod, having an outer end portion to which is secured a striking ball, an externally threaded inner end portion which is threadably receivable within said threaded bore to effect securement of said rod to said sound chamber, a nut threadably receivable on said threaded inner end portion thereof, for effecting locking securement of said rod to said chamber and an intermediate U-shaped portion formed integrally along the length thereof between said end portions thereof, having a length sufficient to serve as a handgrip;

a resilient, elongated member disposed within said cavity of said chamber, one end of which is free-standing and the other end of which of secured to the inner end portion of said rod; and a generally disc-shaped knocker disposed within said cavity of said chamber and secured to the free end of said resilient member, whereby, upon striking said ball, the vibrations of the rod will be imparted to said resilient member and, in turn, said knocker, so that said knocker will strike the walls of said sound chamber, thereby producing a percussion sound.

2. The instrument according to claim 1 additionally including at least one pair of tambourine jingles secured to, and externally of, said sound chamber.

3. The instrument according to claim 2 additionally including means for restraining movement of said jingles.

4. The instrument according to claim 2 additionally including means for demountably securing said jingles to said chamber.

5. The instrument according to claim 4, wherein said securing means comprises a resilient, generally U-shaped clip coupled to said jingles.

6. The instrument according to claim 1, wherein said support means is provided on the inner end of said rod.

7. The instrument according to claim 1, wherein said resilient member is fabricated from flat, spring steel.

8. The instrument according to claim 1, wherein said sound chamber has a generally conical configuration.

9. The instrument according to claim 1, wherein said sound chamber has a generally cylindrical configuration.

10. The instrument according to claim 9, wherein said generally cylindrical sound chamber has a pair of axially-extending, opposing slots formed in the walls thereof.

* * * * *